US008215112B2

(12) United States Patent
Owens et al.

(10) Patent No.: US 8,215,112 B2
(45) Date of Patent: Jul. 10, 2012

(54) FREE PISTON STIRLING ENGINE

(75) Inventors: Kingston Owens, Bedford, NH (US); John T. Dieckmann, Belmont, MA (US); Kenan Sahin, Boston, MA (US)

(73) Assignee: TIAX LLC, Lexington, MA (US)

( * ) Notice: Subject to any disclaimer, the term of this patent is extended or adjusted under 35 U.S.C. 154(b) by 534 days.

(21) Appl. No.: 12/324,797

(22) Filed: Nov. 26, 2008

(65) Prior Publication Data

US 2009/0133397 A1 May 28, 2009

Related U.S. Application Data

(60) Provisional application No. 61/004,498, filed on Nov. 28, 2007.

(51) Int. Cl.
*F02G 1/04* (2006.01)

(52) U.S. Cl. ..... 60/520

(58) Field of Classification Search ..... 60/517–526
See application file for complete search history.

(56) References Cited

U.S. PATENT DOCUMENTS

| | | | | |
|---|---|---|---|---|
| 3,802,196 | A | 4/1974 | Franklin | |
| 4,345,437 | A | 8/1982 | Dineen | |
| 4,434,617 | A | 3/1984 | Walsh | |
| 4,458,489 | A | 7/1984 | Walsh | |
| 4,602,174 | A | 7/1986 | Redlich | |
| 4,888,951 | A * | 12/1989 | Beale | 60/520 |
| 5,174,117 | A | 12/1992 | Naito et al. | |
| 5,642,088 | A | 6/1997 | Unger | |
| 5,907,201 | A * | 5/1999 | Hiterer et al. | 310/30 |
| 6,062,023 | A | 5/2000 | Kerwin et al. | |
| 6,857,267 | B2 * | 2/2005 | Yamagiri et al. | 60/520 |
| 7,168,248 | B2 * | 1/2007 | Sakamoto et al. | 60/517 |
| 7,200,994 | B2 | 4/2007 | Chertok | |
| 7,257,949 | B2 * | 8/2007 | Shimizu et al. | 60/517 |
| 2002/0096884 | A1 | 7/2002 | Budliger | |
| 2004/0128994 | A1 | 7/2004 | Gimsa | |
| 2005/0072148 | A1 | 4/2005 | Francois et al. | |

FOREIGN PATENT DOCUMENTS

| | | |
|---|---|---|
| WO | 0227899 A1 | 4/2002 |

* cited by examiner

*Primary Examiner* — Hoang Nguyen
(74) *Attorney, Agent, or Firm* — Cantor Colburn LLP

(57) ABSTRACT

A free piston Stirling engine, comprising a power piston fitted into a cylinder further includes: a support structure carrying moving magnets for a linear alternator; and a passive structure that at normal operating power and frequency produces a restoring force on the piston in the absence of contact with the cylinder. In one variation, the passive structure further comprises a mass suspended within the piston from at least one spring, such that the mass oscillates under influence of movement of the piston at normal operating power and frequency so as to produce the restoring force. In another variation, the passive structure further comprises: a magnet disposed outside the cylinder at a position and in an orientation to produce a field that opposes a field of a moving magnet carried by the support structure when the piston moves toward the magnet.

18 Claims, 4 Drawing Sheets

FREE PISTON STIRLING ENGINE

RELATED APPLICATIONS

This application claims priority under 35 U.S.C. §119(e) to U.S. Provisional Application Ser. No. 61/004,498, entitled "Free Piston Stirling Engine," filed on Nov. 28, 2007, which is herein incorporated by reference in its entirety.

FEDERAL RESEARCH STATEMENT

This invention was made with Government support under U.S. Navy. Government Contract No.: N00014-07-M-0216. The Government has certain rights in the invention.

BACKGROUND OF INVENTION

1. Field of Invention

The invention relates to improvements to a linear electrical machine for electric power generation or motive drive. In some variations, the invention relates to a free piston engine and alternator in combination. In some further variations, the invention relates to mechanisms for providing restoring forces to pistons in such engines, for example in free piston Stirling engines.

2. Discussion of Related Art

Quiet and efficient electric power generation can be important in a variety of applications. For example, boats and other spaces having power generation systems in close proximity to people have a need for quiet operation. As a result, turbines, internal combustion engines and other power sources are often far too noisy for use in such applications. Free piston Stirling engines, however, operate fairly quietly and have been used to drive linear electrical machines also referred to as linear alternators to generate electric power. Except as otherwise necessitated by context, the term "alternator" is used herein to generically refer to any type of electric power generation device, whether producing alternating current, direct current, or other forms of electric power. Except for the case of the automotive "alternator" which has a built in rectifier to provide 12 volt DC output, the term "alternator" would otherwise be understood to be an electrical machine which produces AC power. These power generation systems are typically best suited by a linear alternator that can operate efficiently within the range of motion of a piston in the free piston Stirling engine (FPSE) that drives the alternator.

A conventional engine-alternator system produces a useful energy output in the form of electrical energy as a result of converting energy from one form to another, more useful form. In the case of a reciprocating system, the linear alternator converts the mechanical energy output by a reciprocating element of an engine into useful electrical energy. A conventional, FPSE has a harmonically reciprocating piston suitable for driving or carrying the moving component of the linear alternator.

In a conventional, FPSE, energy may be input by converting the chemical energy contained in a fuel into heat energy, or heat energy may be input from some other source. The engine converts heat energy into the mechanical energy of motion of a harmonically reciprocating power piston. Because the power piston reciprocates, a stroke in one direction has a beginning and an end, followed by a stroke in the opposite direction which returns the power piston to the beginning of the preceding stroke. A quantum of energy is expended to slow the power piston to a stop at the end of each stroke, after which the piston is caused to return to the beginning of that stroke. In conventional systems, the quantum of energy required may be stored in a spring or other mechanical device, or may be extracted from the useful electrical energy produced by the linear alternator. Such methods reduce the overall efficiency of the machine because of the late stage of energy conversion at which they are employed, and further because of the inefficient nature of the storage and retrieval mechanisms by which such quantum of energy is made available for such use.

SUMMARY OF INVENTION

In a free piston Stirling engine-alternator, the alternator output current preferably only serves to extract power, none of it acts to drive a spring-like restoring force on the piston. Because only a finite amount of alternator output current is available, alternator current used to provide a restoring force is not available to extract energy from the piston, thereby limiting available power. A mechanism is needed to efficiently store energy during part of the piston's motion that can be used during another part of the motion to slow the piston and reverse its direction.

Methods and apparatus described provide restoring forces to return the power piston to the start of a stroke from the end of a preceding stroke.

A free piston Stirling engine, comprising a power piston fitted into a cylinder further includes: a support structure carrying moving magnets for a linear alternator; and a passive structure that at normal operating power and frequency produces a restoring force on the piston in the absence of contact with the cylinder. In one variation, the passive structure further comprises a mass suspended within the piston from at least one spring, such that the mass oscillates under influence of movement of the piston at normal operating power and frequency so as to produce the restoring force. In another variation, the passive structure further comprises: a magnet disposed outside the cylinder at a position and in an orientation to produce a field that opposes a field of a moving magnet carried by the support structure when the piston moves toward the magnet. In yet another variation, the passive structure further comprises: a spring operatively connected between a working surface of the power piston and a mechanical ground outside the cylinder and within a pressure shell defining a compression space about the working surface of the power piston. Any of the above embodiments and aspects can be combined to take advantage of the characteristics of each. Any of the above embodiments and aspects can be used in embodiments wherein the piston is a double-acting piston having compression space at both of two ends.

In some of the above embodiments, the engine is configured to receive a heat input and produce an electrical current output, and further comprises: a field magnet operatively connected to be moved by the power piston; and a stator winding disposed about an axis of motion of the power piston and having electrical output lines carrying the current output.

In others of the above embodiments, the engine is configured to receive an electrical current input and produce a heat transfer output, further comprising: a stator winding disposed about an axis of motion of the power piston and having electrical input lines carrying the current input; and a field magnet operatively connected to move the power piston responsive to the current input to the stator winding; whereby movement of the power piston alternately compresses and expands a working fluid so as to transfer heat energy from one location to another against a heat gradient.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
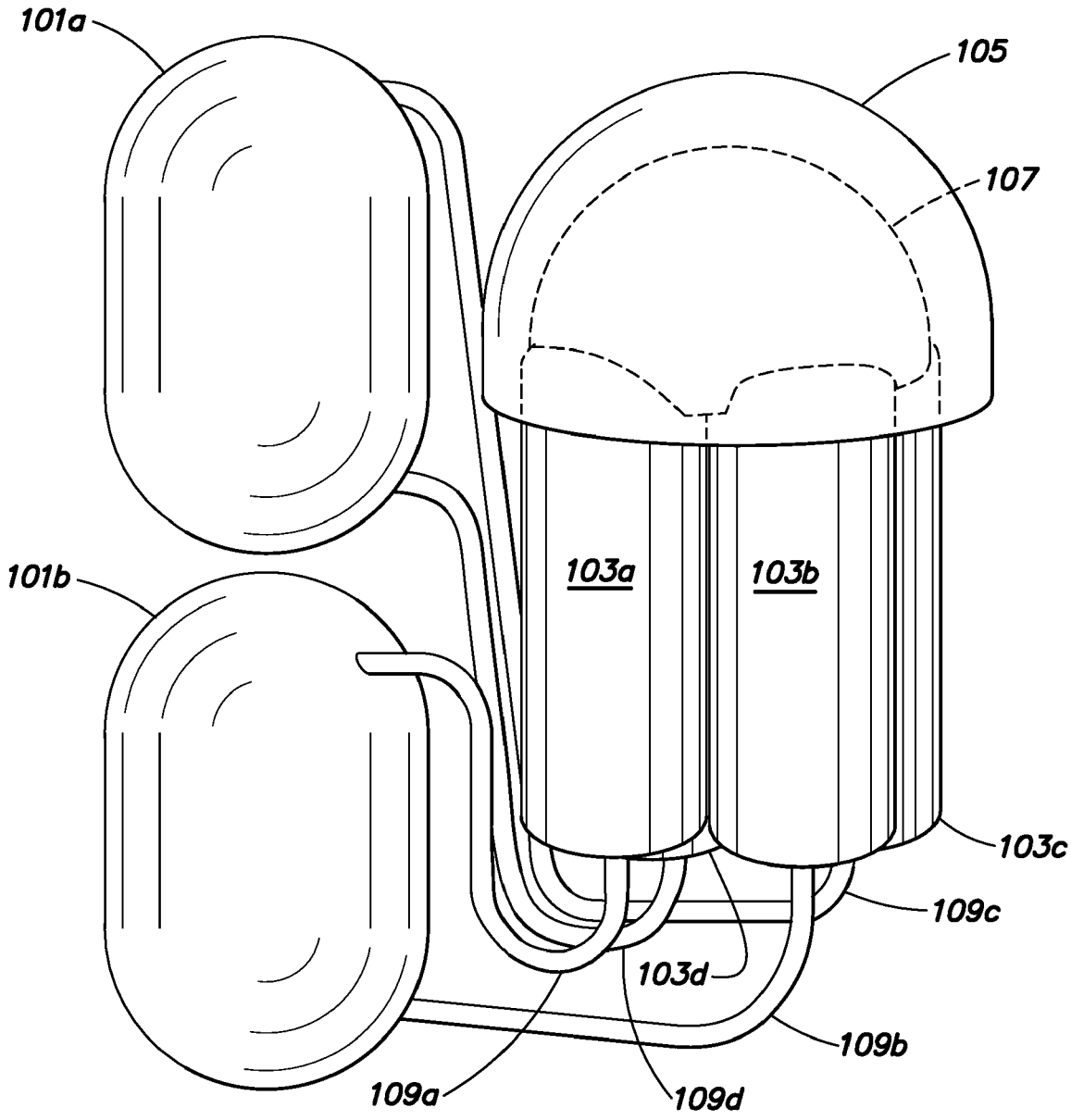
FIG. 1 is a schematic of a free piston Stirling engine embodying aspects of the invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Certain conventional FPSEs have a maximum power above which the power pistons cannot be made to resonate using conventional methods such as forces produced by conventional springs attached to both the piston and the structure containing the piston or bounce space gas compression spring forces. Additional force can be supplied by applying a reversing current to the alternator output, i.e., a current opposing the output current. Such a reversing current produces a backing force which acts as a spring force opposing the piston motion. New methods and apparatus now described can produce harmonic resonance of the piston at higher power.

The invention will be illustrated with reference to aspects of embodiments in which a FPSE converts thermal energy, including thermal energy derived from chemical or other fuels, into electrical energy by means of a linear alternator coupled to the FPSE. FPSEs have other applications, to which the invention is also applicable, such as, phase-change refrigerant compressors (used in small-scale refrigeration applications), water vapor compressors (used in water purification) and liquid refrigerant pumps (used in large-scale refrigeration applications), as well as other applications. In some applications, such as the exemplary application of the production of electrical power from an energy source, the engine receives a thermal energy input and produces an electrical output. In other applications, such as phase-change refrigeration or compressor applications, electrical energy is input to a linear motor, a working fluid is compressed and expanded by the FPSE and work is performed moving thermal energy from one location to another. The use of FPSEs to perform useful work when receiving an input of electrical power will be briefly explained after the detailed description of the exemplary embodiment.

High Power Configuration

To achieve a relatively high power density, a new configuration shown in FIG. 1 is used. Portions of the new configuration including piston modules 101 and displacer modules 103 individually resemble those of a conventional FPSE such as described in U.S. Pat. No. 7,200,994 and in U.S. Pat. No. 6,062,023, both incorporated herein in their entirety by reference, but are specially configured and arranged as now described.

The power pistons are contained in piston modules 101*a* and 101*b* oriented vertically and operate 180° out of phase for nominally balanced, vibration-free operation. The piston modules 101*a* and 101*b* could be arranged in another coaxial orientation 180° out of phase, for nominally balanced, low-vibration operation. The pistons are double acting; that is, each end of a piston has useful work performed on it. This configuration takes advantage of the favorable scaling of alternator power with alternator size. Alternator power scales as the $5^{th}$ power of linear dimension for uniform size scaling while weight scales as linear dimension to the $3^{rd}$ power. Therefore, higher power density is achieved with a single, large alternator compared to two smaller alternators when compared at the same total output power.

In a particular aspect of the illustrative embodiment, additional displacer modules 103*a*, 103*b*, 103*c* and 103*d* have been added, one for each end of each power piston. The displacer pistons contained in the displacer modules run in pairs by phase, each pair being 180° out of phase with the other pair. Ducts 109*a*, 109*b*, 109*c* and 109*d* connect the displacers to the working space at the ends of each power piston. The displacer modules 103*a*, 103*b*, 103*c* and 103*d* form a pattern selected for balanced operation with no vibration or torque. Adjacent displacer modules (103*a*-103*b*, 103*b*-103*c*, 103*c*-103*d* and 103*d*-103*a*) have displacer pistons which move in opposite directions, while diagonally disposed displacer modules (103*a*-103*c* and 103*b*-103*d*) have displacer pistons which move in like directions, thus minimizing both vibration and torque.

Energy is input to the engine by applying heat to the displacer modules 103*a*, 103*b*, 103*c* and 103*d*. A burner 105 converts chemical energy of a fuel to heat, which is transferred through a heat exchanger 107 into the system.

Double Acting Piston Design

In order to extract high power from the exemplary system, it employs double-acting pistons, that is, pistons in which expansion of the working fluid performs work alternately against a surface at one end and a surface at an opposite end. Such a configuration lacks bounce space for a conventional return force generated by gas in the bounce space because both ends of the piston have compression space in which a working fluid performs work on the piston at different times during reciprocation of the piston. Employing the compression of the working fluid to provide the sole piston return force may not be practical due to constraints of the desired thermodynamic cycle, energy losses created by such use, inadequacy of the force thus generated and/or other considerations.

Figure 2:
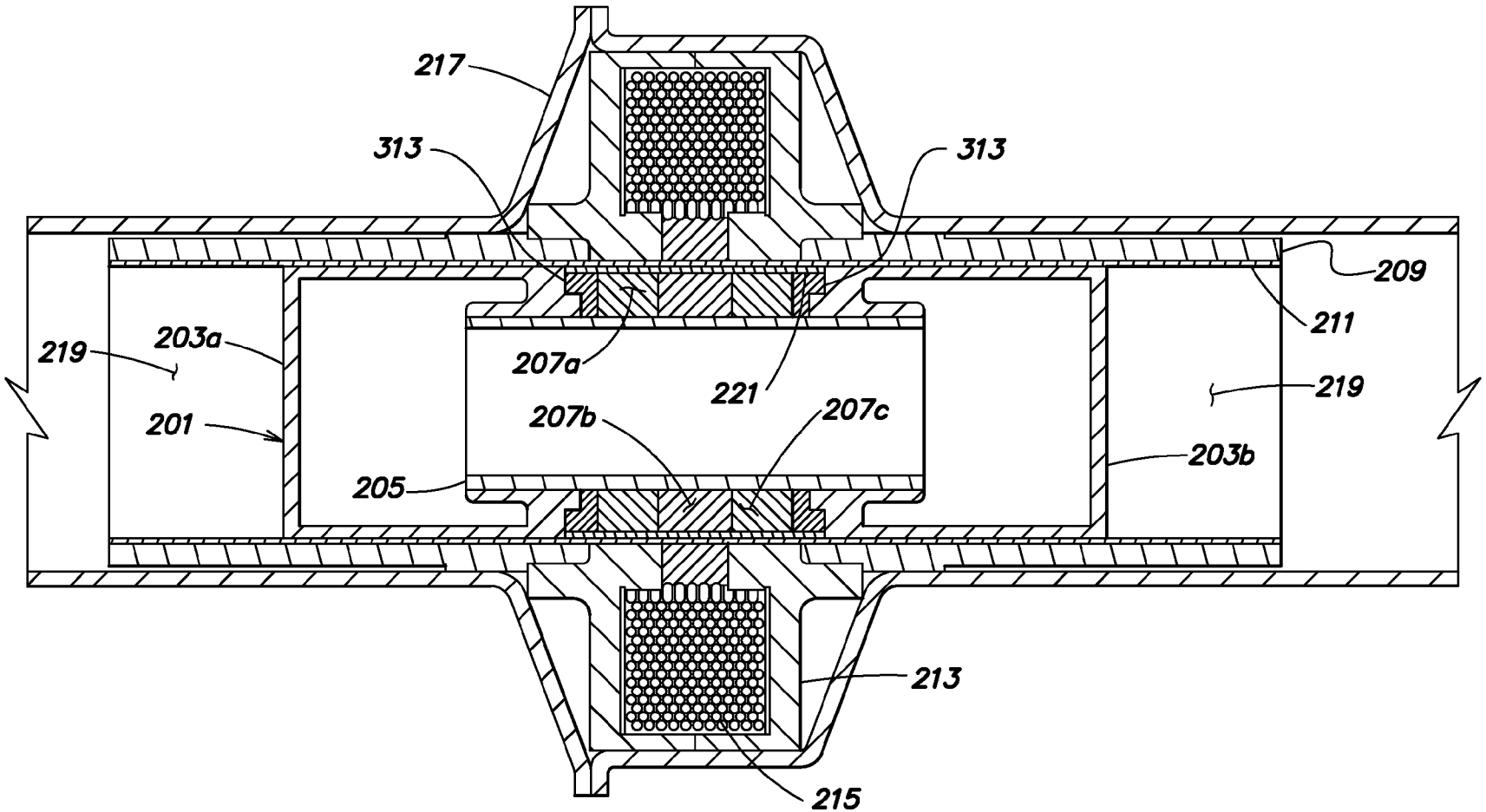
FIG. 2 is a cut-away view of a piston and alternator configuration embodying aspects of the invention.

In order to accommodate a linear alternator in a double-acting Stirling piston engine design, a linear alternator is used in a configuration such as described in U.S. Pat. No. 6,914,351, incorporated herein in its entirety by reference. The outer diameter of the moving alternator magnets are essentially the same as the piston diameter. One embodiment of a power piston in a cylinder, together incorporating a linear alternator, is shown in FIG. 2.

A piston 201 has a first face 203*a* and a second face 203*b*. The piston 201 includes a central support tube 205 to which the faces 203*a* and 203*b* are attached. The support tube 205 also supports magnets 207*a*, 207*b* and 207*c* which produce a moving magnetic field in the linear alternator. A thin non-magnetic liner 221 surrounds the magnets to prevent contamination of or contact with the magnets and improve the behavior of the piston within the cylinder.

The piston 201 is fitted into a cylinder comprised of a cylinder liner support 209 supporting a cylinder liner 211. The cylinder liner support 209 further supports a stator shell 213 carrying stator windings 215, the remaining major components of the linear alternator. Alternator output current develops in stator windings 215 as a result of the magnetic flux variation produced by the moving magnets 207*a*, 207*b* and 207*c*. The stator windings 215 terminate in output terminals, not shown, from which the current is drawn by a consumer of the electrical energy produced.

A pressure shell 217 defines the compression space; the total system pressure is confined by a pressure vessel, not shown. In FIG. 2, the pressure shell 217 defines the compression spaces 219 and only has to withstand the oscillation pressure loads and provide support for the alternator and piston assembly. Another embodiment including an integrated power piston-alternator is shown schematically in FIG. 3.

Figure 3A:
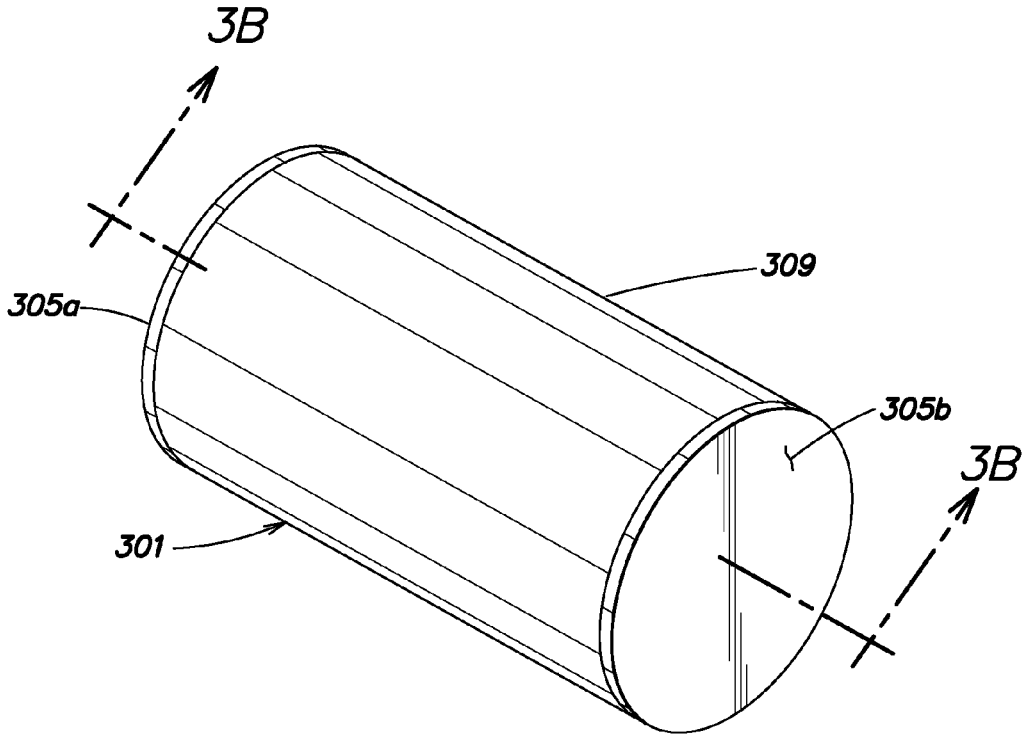
FIG. 3A is a perspective view of another piston embodying aspects of the invention.
Figure 3B:
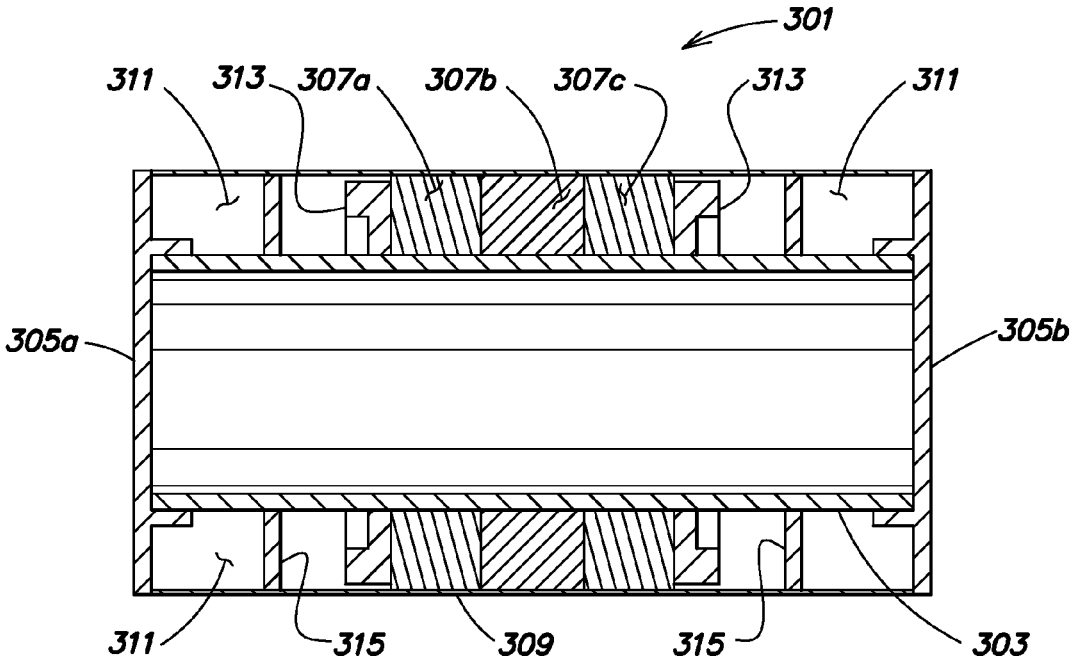
FIG. 3B is a cut-away view of the piston of FIG. 3A.

In the embodiment of FIG. 3, a piston 301 comprises a magnetic steel support structure 303 to which field magnets 307*a*, 307*b* and 307*c* are fitted, held in place by retaining rings 313 along with end caps 305*a* and 305*b* and a shell 309. While the support structure 303 is preferably magnetically soft steel, so as to carry the return flux from magnets 307*a*, 307*b* and 307*c*, the end caps 305*a* and 305*b* and the shell 309 are preferably of a strong, light material having suitable friction and wear characteristics for their use. For example, the shell 309 may preferably be of 0.010-0.015" thick titanium with a suitable low friction, high wear strength coating. Titanium is particularly well suited to this application because of its high resistivity and consequently low eddy current losses when moved through the magnetic fields of the linear alternator during operation. Voids 311 in the structure, for example between the shell 309 and the support 303, may be filled with any suitable material, such as epoxy, to provide such structural support and meet such weight requirements as there may be to achieve the desired resonant frequency of operation and the desired power output.

The alternator design for a 10 kW FPSE generator resulted in a weight of 3.52 kg for the moving magnet structure and 1 kg for the shell and support structure, for a total weight of 4.52 kg for the integrated piston-alternator.

Aspects of an embodiment of the piston may be assembled as follows. First, field magnets 307*a*, 307*b* and 307*c* are assembled to a magnetic steel sleeve 303 which serves as the support. The field magnets 307*a*, 307*b* and 307*c* are then fixtured and bonded to the magnetic steel support structure 303. Bonding may be accomplished by any suitable means, including one or more of adhesives, epoxies, friction, retaining rings 313, etc. Next, structural supports 315 are pressed onto the magnetic steel support structure 303. The shell 309, a titanium sleeve, is slid over the assembly and epoxied in place. The epoxy serves the additional functions noted above, including support of the shell 309 and to fill voids 311 as needed to maintain proper piston weight. Other bonding agents can be used, or no bonding agent, but rather friction, as desired for particular strength and weight goals. End caps 305*a* and 305*b* are pressed onto the support structure 303 after shell 309 is slid over the assembly and preferably before any bonding agent has fully set, so that the resulting outer surface has minimal gaps or breaks. The basic assembly is complete at this point, and simply requires finishing.

The finishing steps include to centerless grind the assembled piston to tight outside diameter tolerances and to precision coat the piston for low friction and high wear resistance.

Piston Balance

In the conventional Stirling engine configurations described in the above-referenced US patents, three mechanisms provide the needed restoring force so that the alternator is not used as a spring. One is the permanent magnet mounted in the alternator stator that functions as a magnetic spring, without added coil current. Second is the phase of the pressure in the compression space, which provides a restoring force. Third is the bounce space which acts like a pneumatic spring. In certain power ranges, these forces are sufficient to provide the necessary restoring force on the piston.

For the double acting configuration described here, there is no bounce space; a passive component provides the restoring force. In some embodiments, the compression space at each end of the piston and the permanent magnet spring provide the restoring force. In other embodiments, the restoring force is enhanced by providing components which create higher-order resonances, for example, passive components provided within the piston structure as explained further below.

Force balance on the power piston in cyclic steady state means that the component of the alternator current in phase with the piston amplitude satisfies the following equation:

$$\alpha I_x = -m\omega^2 x + k_m x + 2\Delta PA\cos(\phi_P) \quad \text{Eq. 1}$$

where the nomenclature is defined in Table 1

TABLE 1

Nomenclature for Equation 1

| Symbol | Definition |
|---|---|
| $\alpha$ | Newtons/Amp, force constant for alternator |
| $I_x$ | Amps, amplitude of alternator current at same phase as piston displacement |
| m | Total mass of piston |
| $\omega$ | Radians/second, $2\pi f$, f = FPSE oscillation frequency |
| $k_m$ | Newtons/m, magnetic spring constant |
| $\Delta P$ | Pa, compression space pressure swing amplitude |
| A | $m^2$, piston area |
| $\phi_P$ | Radians, phase of compression space pressure swing with respect to piston displacement |

It is very desirable to have $I_x=0$ for optimum alternator efficiency and power capability. In some embodiments, this condition cannot be achieved in the 10 kW engine described here without additional restoring force mechanisms. Two mechanisms are proposed: the addition of stationary magnets to the alternator stator to provide additional magnetic restoring forces and a resonant mass and spring installed inside the power piston.

Figure 4:
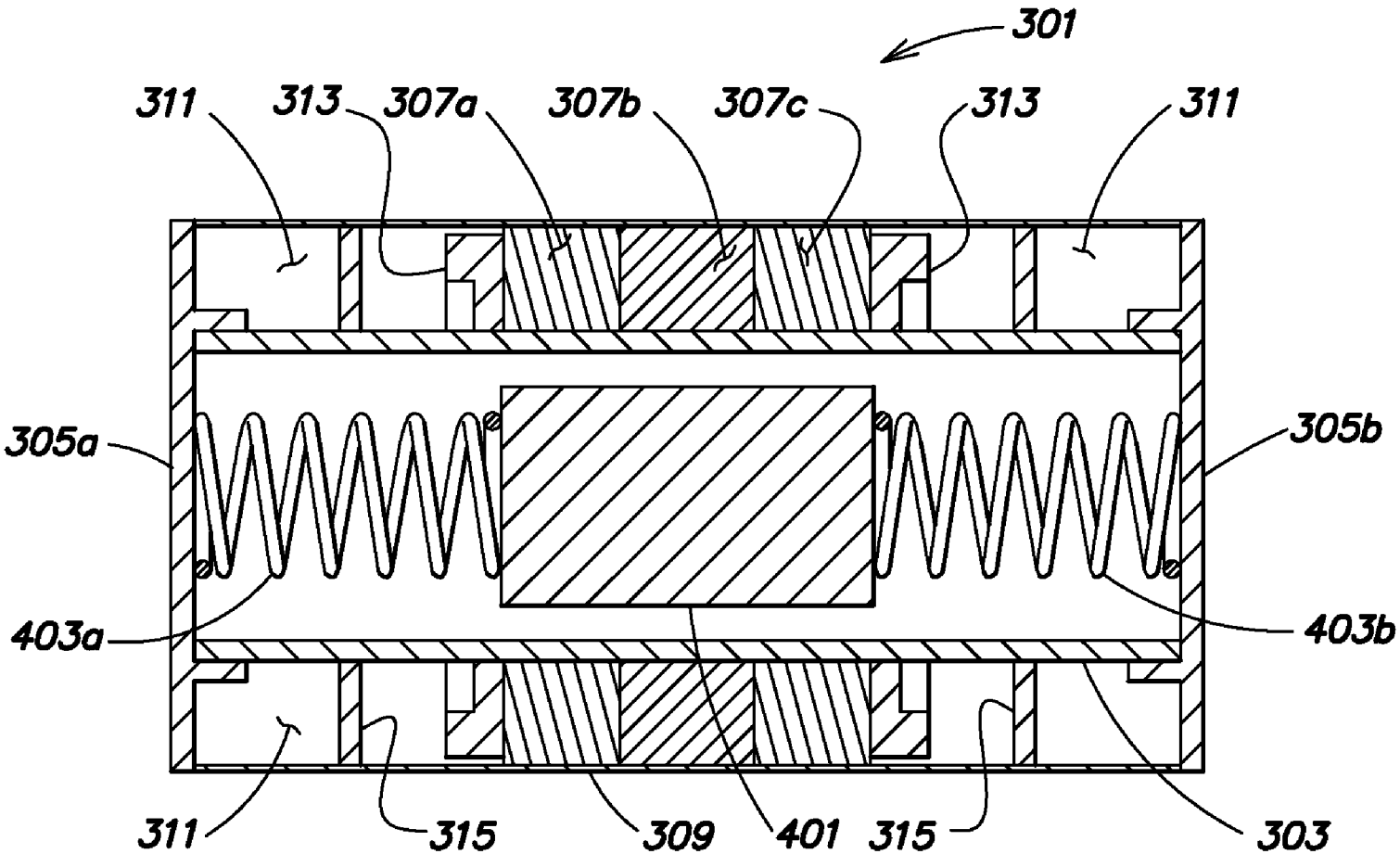
FIG. 4 is a cut-away view of a piston of FIG. 3A embodying other aspects of the invention.

A piston including such a resonant mass and springs is shown schematically in FIG. 4. The illustrative piston 301, similar to that described above in connection with FIG. 3, further includes a mass 401 suspended from end caps 305*a* and 305*b* by springs 403*a* and 403*b*. Inertia of the mass 401 and the spring forces produced by springs 403*a* and 403*b* permit a balancing of forces to be achieved as described below.

The equation of motion for the mass inside the power piston is $$m(\ddot{x}+\ddot{y}) = -ky \quad \text{Eq. 2}$$

where x is the position of the power piston, y is the position of the balancing mass with respect to the power piston, m is the mass of the balancing mass, and k is the spring constant. The force on the power piston, $f_x$, from the reaction force of the spring is $$f_x = ky \quad \text{Eq. 3}$$

The balance equation (Eq. 1) becomes $$\alpha I_x = -M\omega^2 x + k_m x + 2\Delta PA\cos(\phi_P) - ky \quad \text{Eq. 4}$$

In cyclic steady-state, y is given by $$y = \frac{m\omega^2}{k - m\omega^2}x \quad \text{Eq. 5}$$

Using the following representative values from the design of a 10 kW FPSE

| Parameter | Value |
|---|---|
| M | 4.5 kg, power piston mass |
| $\omega$ | $2\pi \times 60$ radians/sec, FPSE angular frequency |
| $k_m$ | $7 \times 10^4$ N/m, magnetic spring force |
| x | $13.86 \times 10^{-3}$ m, power piston displacement amplitude |
| $\Delta P$ | $3.98 \times 10^5$ Pa, compression space pressure swing amplitude |
| A | $9.212 \times 10^{-3}$ m$^2$, piston area |
| $\phi_p$ | −20.17°, pressure phase angle with respect to power piston position |

then a balancing mass of about 0.513 kg sprung with a spring constant of about $3.65\times10^4$ N/m, less than the displacer spring constant of $1.8\times10^5$ N/m, is sufficient to set $I_x$ to zero in Eq. 4.

Additional magnets, not shown, can also be used at the ends of the stator to serve as magnetic springs. They simply need to be positioned so as to have fields which oppose those of the moving magnets, so as to produce a restoring force as the piston moves off of a center position.

Alternatively, additional springs, not shown, internal to the pressure shell (FIG. 2, 217), can provide the restoring force. In such an aspect of an embodiment, each such spring would run from an end cap (FIG. 2, 203*a*, 203*b*) to any suitable mechanical ground, such as an attachment point on the inside of the pressure shell (FIG. 2, 217).

Receiving Electrical Power to Perform Work

The linear alternator of the exemplary embodiment can also function as a motor with which to drive the piston of a FPSE at its harmonic oscillation frequency. Those skilled in this art will understand that with little modification, alternators and motors are analogs of each other, such that many motor designs and alternator designs may be operated both to convert mechanical energy to electrical energy and to convert electrical energy to mechanical energy, simply by changing which mode is an input and which is an output.

Because of the duality of alternator and motor designs, and because FPSEs alternately compress and expand a working fluid, FPSEs, when driven by a linear motor, operate as refrigeration units that perform work to actively transfer heat from one location to another, generally hotter, location. The structure of such designs is substantially the same as that described in connection with the exemplary embodiment, but having the input and output re-defined. In these designs, as noted above, the electrical power is an input to the motor (formerly defined to be an alternator), and the output is the movement of heat energy against a heat gradient from a first location to a second location (i.e., the performance of useful work).

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A free piston Stirling engine, comprising a power piston fitted into a cylinder including:

a support structure carrying moving magnets for a linear alternator, the moving magnets disposed within the cylinder;

a passive structure that at normal operating power and frequency produces a restoring force on the power piston in the absence of contact with the cylinder.

2. The engine of claim 1, the passive structure further comprising:

a mass suspended within the power piston from at least one spring, such that the mass oscillates under influence of movement of the power piston at normal operating power and frequency so as to produce the restoring force.

3. The engine of claim 1, the passive structure further comprising:

a magnet disposed outside the cylinder at a position and in an orientation to produce a field that opposes a field of a moving magnet carried by the support structure when the power piston moves toward the magnet.

4. The engine of claim 1, the passive structure further comprising:

a spring operatively connected between a working surface of the power piston and a mechanical ground outside the cylinder and within a pressure shell defining a compression space about the working surface of the power piston.

5. The engine of claim 1, wherein the power piston is a double-acting power piston having compression space at both of two ends.

6. The engine of claim 5, the passive structure further comprising:

a mass suspended within the power piston from at least one spring, such that the mass oscillates under influence of movement of the power piston at normal operating power and frequency so as to produce the restoring force.

7. The engine of claim 5, the passive structure further comprising:

a magnet disposed outside the cylinder at a position and in an orientation to produce a field that opposes a field of a moving magnet carried by the support structure when the power piston moves toward the magnet.

8. The engine of claim 5, the passive structure further comprising:

a spring operatively connected between a working surface of the power piston and a mechanical ground outside the cylinder and within a pressure shell defining a compression space about the working surface of the power piston.

9. The engine of claim 5, configured to receive a heat input and produce an electrical current output, further comprising:

a field magnet operatively connected to be moved by the power piston; and a stator winding disposed about an axis of motion of the power piston and having electrical output lines carrying the current output.

10. The engine of claim 5, configured to receive an electrical current input and produce a heat transfer output, further comprising:

a stator winding disposed about an axis of motion of the power piston and having electrical input lines carrying the current input; and a field magnet operatively connected to move the power piston responsive to the current input to the stator winding; whereby movement of the power piston alternatively compresses and expands a working fluid so as to transfer heat energy from one location to another against a heat gradient.

11. The engine of claim 5, configured to receive an electrical current input and produce a heat transfer output, further comprising:

a stator winding disposed about an axis of motion of the power piston and having electrical input lines carrying the current input; and a field magnet operatively connected to move the power piston responsive to the current input to the stator winding; whereby movement of the power piston alternatively intakes a fluid at an intake pressure and then compresses and exhausts the fluid at an exhaust pressure higher than the intake pressure.

12. The engine of claim 11, wherein said fluid is a working fluid of one of a refrigeration cycle or a heat pump cycle.

13. A free piston Stirling engine comprising:

two power piston modules positioned substantially along a common axis, the power piston modules each including a double-acting power piston, the power pistons of the two power piston modules oscillating approximately 180 degrees out of phase with each other; and four displacer modules, two displacer modules of the four displacer modules operably connected to each power piston module;

wherein axes of the four displacer modules are arranged substantially parallel to each other in a quadrilateral pattern, displacer pistons of adjacent displacer modules moving in opposing directions and displacer pistons of diagonally opposed displacer modules moving in the same direction.

14. The free piston Stirling engine of claim 13, wherein heat is applied to a first end of each displacer module, and a second end of each displacer module is operably connected to a working space of a power piston module via a duct.

15. The free piston Stirling engine of claim 13, wherein each power piston is fitted into a cylinder and includes:

a support structure carrying moving magnets for a linear alternator, the moving magnets disposed within the cylinder; and a passive structure that at normal operating power and frequency produces a restoring force on the power piston in the absence of contact with the cylinder.

16. The free piston Stirling engine of claim 15, the passive structure further comprising:

a mass suspended within each power piston from at least one spring, such that the mass oscillates under influence of movement of the power piston at normal operating power and frequency so as to produce the restoring force.

17. The free piston Stirling engine of claim 15, the passive structure further comprising:

a magnet disposed outside the cylinder at a position and in an orientation to produce a field that opposes a field of a moving magnet carried by the support structure when the power piston moves toward the magnet.

18. The free piston Stirling engine of claim 15, the passive structure further comprising:

a spring operatively connected between a working surface of each respective power piston and a mechanical ground outside the cylinder and within a pressure shell defining a compression space about the working surface of each power piston.

* * * * *